US010907332B2

(12) United States Patent
Lambert et al.

(10) Patent No.: US 10,907,332 B2
(45) Date of Patent: Feb. 2, 2021

(54) FLUSH ACTUATOR ASSEMBLY

(71) Applicant: Kohler Co., Kohler, WI (US)

(72) Inventors: Tony Lambert, Sheboygan, WI (US); Daniel Halloran, Fredonia, WI (US); Randy Mesun, Sheboygan, WI (US); Jonathan Guay, Cary, IL (US); Keith Muellenbach, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 16/102,387

(22) Filed: Aug. 13, 2018

(65) Prior Publication Data

US 2019/0071854 A1 Mar. 7, 2019

Related U.S. Application Data

(60) Provisional application No. 62/553,289, filed on Sep. 1, 2017.

(51) Int. Cl.

| | |
|---|---|
| ***E03D 5/09*** | (2006.01) |
| ***E03D 1/34*** | (2006.01) |
| ***E03D 5/094*** | (2006.01) |

(52) U.S. Cl.

CPC ..... *E03D 5/094* (2013.01); *E03D 1/34* (2013.01)

(58) Field of Classification Search

CPC ..... E03D 5/09; E03D 5/094; E03D 5/105; E03D 1/34

USPC ..... 4/405, 411, 412, 413, 414

See application file for complete search history.

(56) References Cited

U.S. PATENT DOCUMENTS

| | | | | |
|---|---|---|---|---|
| 5,775,366 | A | 7/1998 | Ray et al. | |
| 6,089,542 | A | 7/2000 | Caravella et al. | |
| 6,453,480 | B1 * | 9/2002 | Yeh | E03D 5/02 16/110.1 |
| 6,775,859 | B1 | 8/2004 | Gorginians | |
| 7,958,576 | B1 | 6/2011 | Johnson et al. | |
| 9,340,962 | B2 * | 5/2016 | Tanimoto | E03D 5/094 |
| 9,447,570 | B1 * | 9/2016 | Schuster | E03D 5/094 |
| 2002/0073482 | A1 | 6/2002 | Hashemi | |
| 2003/0009824 | A1 | 1/2003 | Duncan | |
| 2004/0026640 | A1 | 2/2004 | Enomoto et al. | |
| 2004/0083542 | A1 | 5/2004 | Oury | |
| 2008/0115263 | A1 | 5/2008 | Siena et al. | |
| 2008/0201834 | A1 | 8/2008 | Collura | |
| 2008/0201835 | A1 | 8/2008 | Ueno et al. | |

(Continued)

FOREIGN PATENT DOCUMENTS

| | | |
|---|---|---|
| CN | 201567649 | 9/2010 |
| CN | 202440906 | 9/2012 |

(Continued)

*Primary Examiner* — Janie M Loeppke

(74) *Attorney, Agent, or Firm* — Lempia Summerfield Katz LLC

(57) ABSTRACT

A flush actuator assembly for a plumbing fixture includes a housing, a handle and a lever. The housing is configured to be removably coupled to the plumbing fixture. The handle is pivotally and removably coupled to the housing. The handle includes a stem configured to extend through the plumbing fixture and into the housing. The arm is removably coupled to the stem within the housing. The arm is configured to pivot with the handle. The lever is at least partially disposed in the housing, and is configured to be selectively disengaged from the stem to removably couple the handle to the housing.

20 Claims, 5 Drawing Sheets

(56) References Cited

U.S. PATENT DOCUMENTS

| | | | |
|---|---|---|---|
| 2008/0295238 | A1 | 12/2008 | Hawley et al. |
| 2009/0007324 | A1 | 1/2009 | Pule et al. |
| 2009/0199910 | A1 | 8/2009 | Brown |
| 2009/0307833 | A1 | 12/2009 | Ciski et al. |
| 2011/0107506 | A1 | 5/2011 | Nasrallah |
| 2013/0232678 | A1 | 9/2013 | Han |
| 2014/0090158 | A1 | 4/2014 | Jensen |
| 2014/0289946 | A1 | 10/2014 | Tanimoto et al. |
| 2014/0326331 | A1 | 11/2014 | Mimone |
| 2015/0059869 | A1 | 3/2015 | Huang et al. |

FOREIGN PATENT DOCUMENTS

| | | |
|---|---|---|
| CN | 103498501 | 1/2014 |
| CN | 104074249 | 10/2014 |
| CN | 205062945 | 3/2016 |
| DE | 19753947 | 6/1999 |
| DE | 202012002875 | 6/2013 |
| DE | 202014104486 | 10/2014 |
| EP | 0997585 | 5/2000 |
| EP | 1916344 | 4/2008 |
| EP | 1964988 | 9/2008 |
| EP | 2543782 | 1/2013 |
| EP | 2775048 | 9/2014 |
| EP | 2878738 | 6/2015 |
| FR | 2684705 | 6/1993 |
| FR | 2712320 | 5/1995 |
| WO | WO 02075063 | 9/2002 |
| WO | WO2004067860 | 8/2004 |
| WO | WO2008085018 | 7/2008 |
| WO | WO2012104453 | 8/2012 |
| WO | WO2013009159 | 1/2013 |
| WO | WO2014046557 | 3/2014 |

* cited by examiner

FLUSH ACTUATOR ASSEMBLY

CROSS-REFERENCE TO RELATED PATENT APPLICATIONS

This application claims the benefit of and priority to U.S. Provisional Application No. 62/553,289, filed Sep. 1, 2017, the entire disclosure of which is hereby incorporated by reference herein.

BACKGROUND

The present application relates generally to a flush actuator for a plumbing fixture. In particular, this application relates to a single-flush, cable-driven flush actuator assembly.

Plumbing fixtures, such as toilets, urinals, or bidets, can include an actuator assembly for performing a flush function. The flush function is typically controlled by an actuator handle coupled to the plumbing fixture, which can in turn be coupled to an arm attached to a rod or chain. The rod or chain is typically coupled to a flush valve (e.g., a flapper valve, a canister valve, etc.) and is configured to lift the flush valve when a user presses the actuator handle to perform a flushing cycle. These conventional types of flush actuators can be difficult to install within, for example, a toilet tank, and can have a poor tactile feel for a user performing a flush function. Furthermore, these types of actuators may be prone to premature wear and breakage due to, for example, exposure to water within the tank.

In addition, the actuator handle itself is typically connected to the plumbing fixture using fasteners, such as set screws or other hardware, which can require significant time and effort to install or remove from the plumbing fixture, and can require the use of tools or other hardware for installation or removal. This is limiting in that an end user or an installer is unable to quickly and easily install/remove the actuator handle to or from the plumbing fixture, such as when the actuator requires repair or when a user wishes to change the aesthetics of the plumbing fixture by replacing the actuator handle.

Therefore, it would be advantageous to provide a flush actuator for a plumbing fixture that addresses one or more of the above noted limitations associated with conventional flush actuator assemblies. These and other advantageous features will become apparent to those reviewing the present disclosure.

SUMMARY

One embodiment relates to a flush actuator assembly for a plumbing fixture. The flush actuator assembly includes a housing, a handle, an arm, and a lever. The housing is configured to be removably coupled to the plumbing fixture. The handle is pivotally and removably coupled to the housing. The handle includes a stem configured to extend through the plumbing fixture and into the housing. The arm is removably coupled to the stem within the housing and is configured to pivot with the handle. The lever is at least partially disposed in the housing and is configured to be selectively disengaged from the stem to removably couple the handle from the housing.

Another embodiment relates to a flush actuator assembly. The flush actuator assembly includes a housing, a handle, an arm, a lever, and a biasing member. The handle includes a stem extending therefrom and is configured to be pivotally and removably coupled to the housing. The arm is disposed in the housing and is configured to receive at least a portion of the stem and to pivot with the handle. The lever is at least partially disposed in the housing and is configured to be selectively disengaged from the stem to removably couple the handle to the housing. The biasing member is positioned between a portion of the lever and the housing, and is configured to bias the lever toward the stem so as to maintain engagement between the lever and the stem.

Another embodiment relates to a flush actuator assembly for a plumbing fixture. The flush actuator assembly includes a housing, a handle, an arm, and a lever assembly. The handle includes a stem and is configured to be removably coupled to the housing. The arm is disposed in the housing and is configured to receive at least a portion of the stem and to pivot with the handle. The lever assembly is at least partially disposed in the housing and is configured to be selectively disengaged from the stem to removably couple the handle to the housing. A portion of the lever assembly is accessible at an outer portion of the housing and is configured to be actuated to remove the handle from the housing.

DETAILED DESCRIPTION

Referring generally to the FIGURES, disclosed herein are flush actuator assemblies for a plumbing fixture that use a cable for connecting to a flush valve to perform a flush function, thereby eliminating the need for mechanical lever arms, rods, and/or chains to perform a flush function. In addition, the flush actuator assemblies include an actuator handle removably coupled to the plumbing fixture using a quick-release mechanism (e.g., a lever, a spring-loaded lever, etc.). The quick release mechanism can allow for simple and quick installation or removal of the actuator handle by a user/installer without the use of tools to facilitate replacement of the actuator handle, and cleaning or servicing of the plumbing fixture. In this way, the disclosed flush actuator assembly provides for improvements relating to durability and functionality of a plumbing fixture, while providing for an improved tactile feel for a user performing a flush function. Additionally, the disclosed flush actuator assembly provides for improvements relating to servicing, repair and customization of a plumbing fixture.

Figure 1:
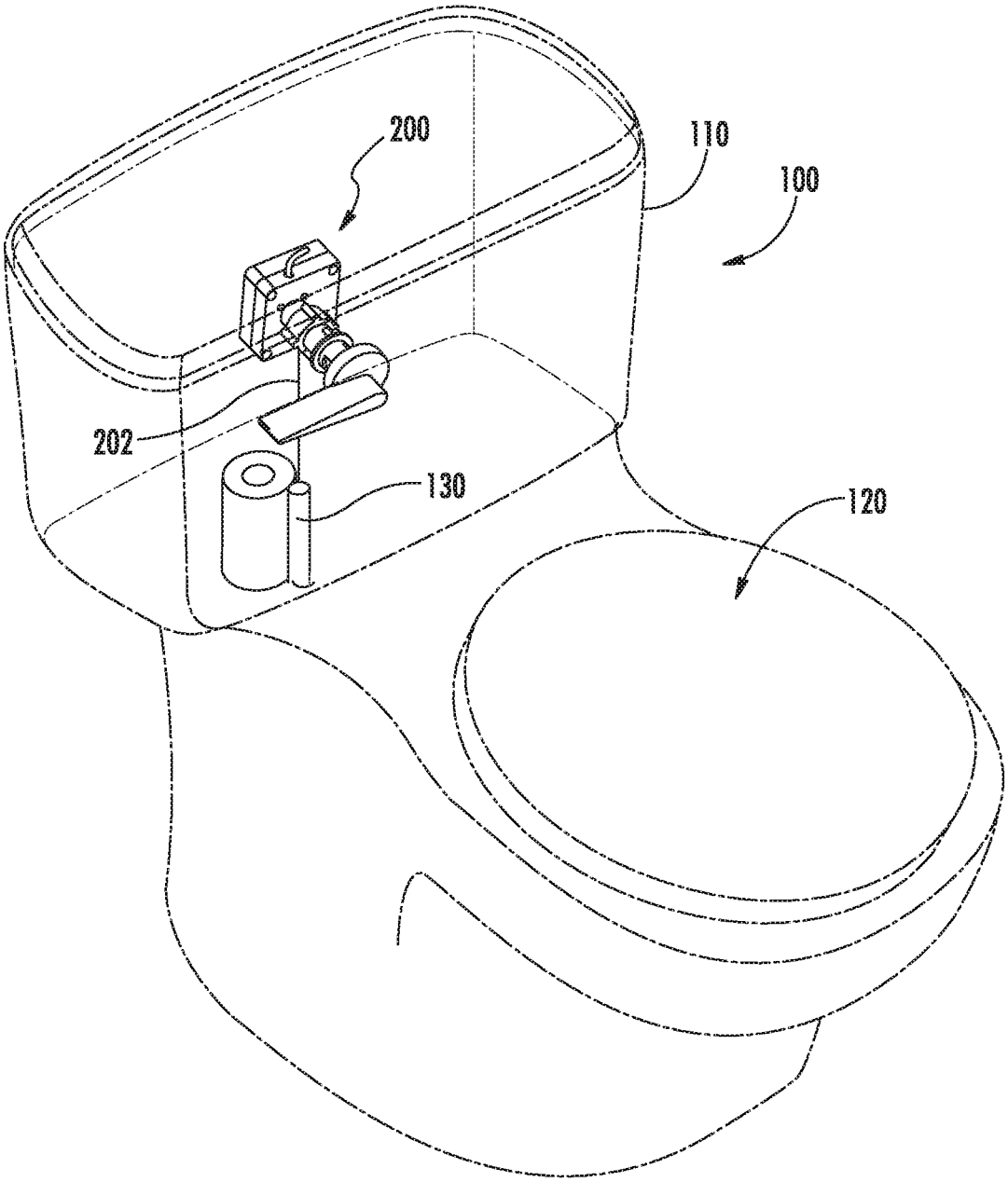
FIGS. 1-2 are perspective views of a toilet including a flush actuator assembly according to an exemplary embodiment.
Figure 2:
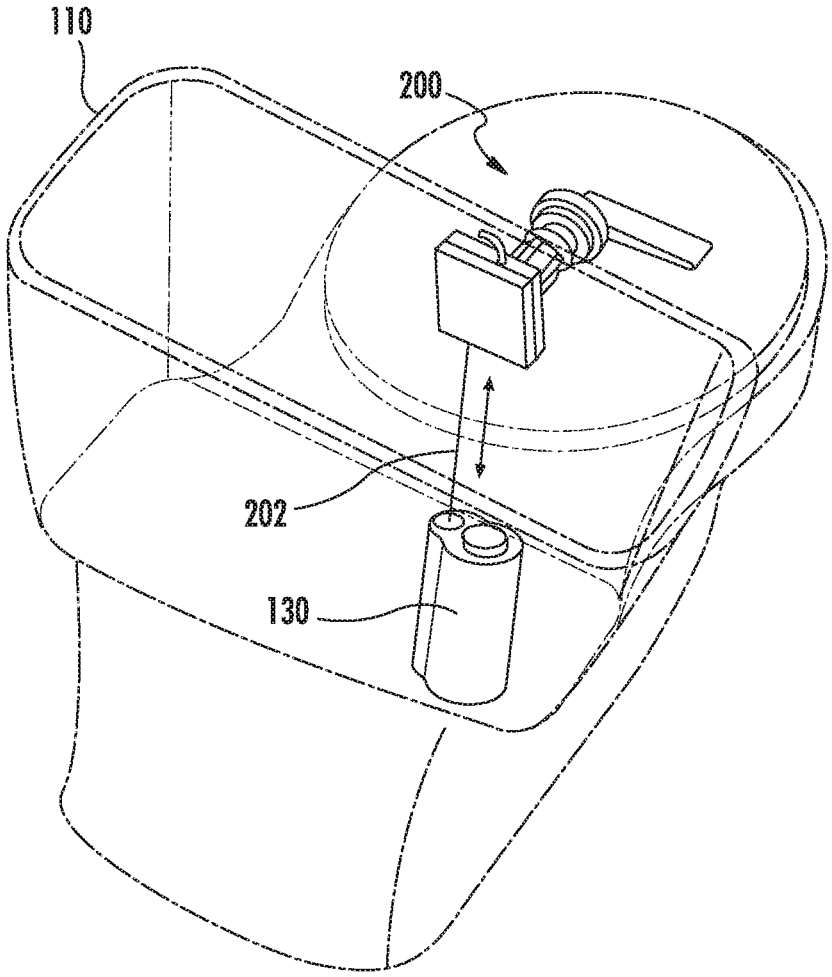

Referring to FIGS. 1-2, a plumbing fixture is shown as a toilet 100 according to an exemplary embodiment. Although the plumbing fixture is shown as a toilet in the embodiment of FIG. 1, it is appreciated that the plumbing fixture can be a bidet, a urinal, or another type of plumbing fixture, according to other exemplary embodiments. As shown in FIG. 1, the toilet 100 includes a tank 110 and a bowl 120. The tank 110 includes a hollow interior with a flush valve 130, shown as a canister flush valve, coupled within the tank. According to other exemplary embodiments, the flush valve 130 is a flapper valve or any other type of valve suitable for use within the plumbing fixture 100. The flush valve 130 can control evacuation of human waste from the toilet bowl 120 by controllably releasing water from the tank 110 into the bowl, and by releasing the contents in the bowl to a drain pipe or sewer system, as would be understood by a person of skill in the art.

Still referring to FIGS. 1-2, the toilet 100 further includes a flush actuator assembly 200 coupled to the tank 110. The flush actuator assembly 200 is removably coupled to the tank 110 such that a user or an installer can remove the actuator assembly 200 from the tank 110 without the use of tools as desired to, for example, replace or repair the actuator assembly. The flush actuator assembly 200 is configured to allow a user to selectively operate the flush valve 130 to perform a flush function. As shown in FIGS. 1-2, the flush actuator assembly 200 is operatively coupled to the flush valve 130 via a single cable 202. According to various exemplary embodiments, the cable 202 can be a wire cable, a plastic cable, or any other type of cable. In the embodiment shown, the flush valve 130 is a "single-flush" type canister flush valve, however, the flush valve 130 may be a dual-flush type canister flush valve according to other exemplary embodiments. The flush actuator assembly 200 is configured such that a user can perform a flush function by pressing down on a handle 230 of the actuator assembly 200 (shown in FIG. 2), thereby lifting the cable 202 to operate the flush valve 130.

Figure 3:
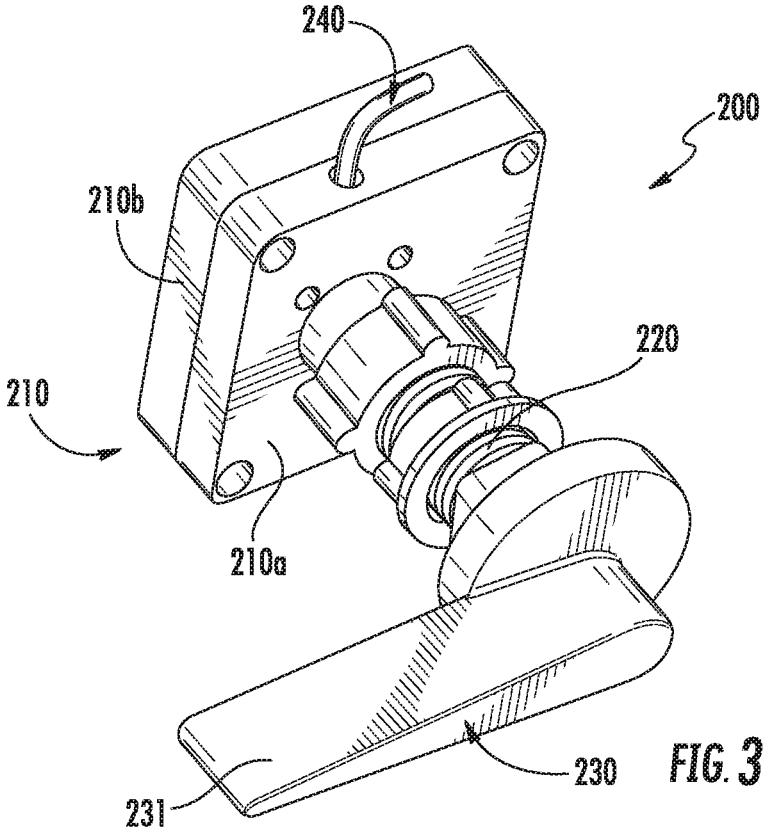
FIG. 3 is a perspective view of the flush actuator assembly of FIG. 1.
Figure 4:
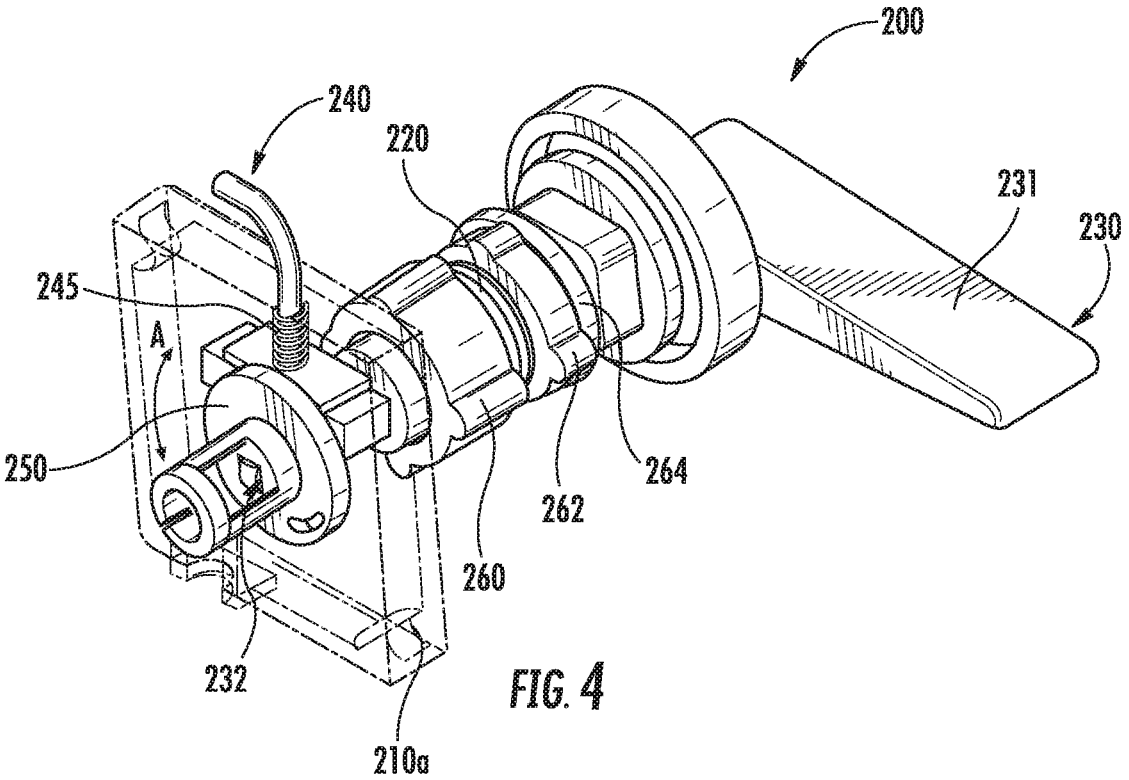
FIG. 4 is another perspective view of the flush actuator assembly of FIG. 1.

Referring to FIGS. 3-4, the flush actuator assembly 200 includes a housing 210 (e.g., an enclosure, a container, etc.), a sleeve 220 (e.g., a tubular member, a hollow cylindrical member, etc.), a handle 230 (e.g., a trip lever, etc.), a lever 240 (e.g., a quick-release mechanism, a spring-loaded lever, etc.), and an arm 250 (e.g., a link member, etc.).

According to the exemplary embodiment shown in FIGS. 3-4, the housing 210 includes a front housing half **210*a* and a rear housing half 210*b*. The front housing half 210*a* and the rear housing half 210*b* each have a generally rectangular shape, although it is appreciated that the housing halves may have a different shape, according to other exemplary embodiments (e.g., circular, pentagonal, octagonal, etc.). The housing halves 210*a* and 210*b* are removably coupled together via one or more fasteners, such as bolts, screws, or other types of fastening arrangements (e.g., snaps, interference fit, etc.). In this way, a user or an installer can access the contents of the housing 210 to, for example, perform repairs or to replace a component of the assembly. According to other exemplary embodiments, the housing 210 has a one-piece design. The housing 210 can house or contain the arm 250, at least a portion of the lever 240, and a portion of the handle 230, according to an exemplary embodiment. The housing 210 is further configured to receive a portion of the cable 202 through an opening 214, as shown in FIGS. 1-2. The housing 210 is disposed within the tank 110 of the toilet 100, according to the exemplary embodiment of FIGS. 1-2. The interior of the housing 210 is substantially sealed off from the surrounding environment, so as to prevent contaminants from entering therein (e.g., water, bacteria, mold, etc.). This can, advantageously, protect the components of the assembly contained within the housing 210** and to prolong their useful life.

Still referring to FIGS. 3-4, a sleeve 220 is coupled to the front housing half **210*a*. The sleeve 220 is substantially cylindrical in shape and extends outwardly away from the front housing half 210*a*. According to an exemplary embodiment, the sleeve 220 is removably coupled (e.g., threadably coupled, etc.) to the front housing half 210*a* to allow for removal of the sleeve 220 therefrom. According to other exemplary embodiments, the sleeve 220 is integrally formed with the front housing half 210*a*. The sleeve 220 includes an outer threaded portion and a hollow interior. The sleeve 220 defines an opening that is aligned with an opening 216 disposed within the front housing half 210*a* (see FIG. 5B). According to the exemplary embodiment of FIGS. 1-2, the sleeve 220 can be inserted through an aperture of the tank 110 to removably couple the assembly 200 to the toilet 100. The sleeve 220 can threadably receive an inner nut 260 and an outer nut 262 (shown in FIG. 4) along the outer threaded portion of the sleeve. The inner nut 260 and the outer nut 262 can cooperate to couple the assembly 200 to the tank 210**.

For example, as shown in FIGS. 1-2, the inner nut 260 and the outer nut 262 can sandwich at least a portion of the tank 110 therebetween, to thereby couple the assembly 200 to the tank 110. A user or an installer can selectively rotate either nut 260 or 262 along the outer threaded portion of the sleeve 220 without the use of tools (e.g., by hand, etc.), to thereby adjust the position of the housing 210 and/or the sleeve 220 relative to the tank 110. The inner nut 260 and the outer nut 262 can include features that allow for tightening/loosening of the nuts along the sleeve 220 by using a tool or by hand (e.g., protrusions, hex shaped features, knurls, etc.). Furthermore, this adjustment aspect can, advantageously, facilitate use of the actuator assembly 200 across different plumbing fixtures having different tank configurations, such as different tank wall thicknesses or different relative positioning of plumbing components within the tank.

According to the exemplary embodiment of FIGS. 3 and 4, a handle 230 is removably and rotatably coupled to the housing 210. A bushing 264 is disposed on the sleeve 220 adjacent the handle 230. The bushing 264 can help permit relative rotational movement between the handle 230 and, for example, the tank 110 and/or the sleeve 220. The handle 230 includes a stem portion 232 extending away from a front handle portion 231. The stem portion 232 can be inserted into the sleeve 220 and into the housing 210 through the opening 216 of the front housing half **210*a* (see FIG. 6). The stem portion 232 includes a poke-a-yoke feature 234 located at a distal end of the stem portion 232, away from the handle portion 231 (see FIGS. 5 and 6). The poke-a-yoke feature 234 can be inserted into the arm 250 within the housing 210. The poke-a-yoke feature 234 can, advantageously, set a rotational position of the arm 250 relative to the housing 210. The handle 230 is permitted to rotate or pivot within the sleeve 220 and the housing 210, such that the arm 250 rotates with the handle 230 along an angular direction indicated generally by arrow "A" in FIG. 4. The sleeve 220 defines a rotational axis for the handle 230** to rotate/pivot about.

According to the exemplary embodiment shown in FIG. 2, the cable 202 is coupled to a free end of the arm 250 and extends downward through the opening 214 in the housing 210 toward the flush valve 130. The arm 250 can rotate or pivot along with the handle 230 to lift the cable 202 and thereby actuate the flush valve 130 to perform a flush function. For example, when a user of the plumbing fixture 100 presses down on the handle portion 231 of the handle 230, the stem portion 232 will rotate the arm 250 along the angular direction A. This rotational movement will cause the cable 202 to move in an upward direction, thereby actuating or operating the flush valve 130, shown in FIGS. 1-2.

Figure 5:
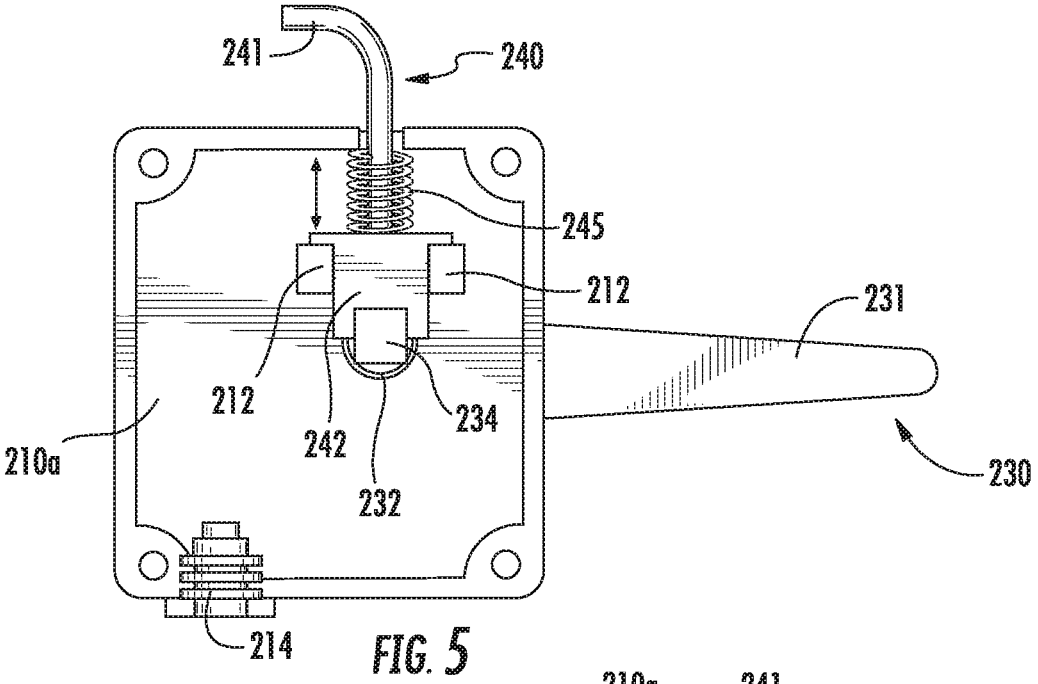
FIG. 5 is a rear view of the flush actuator assembly of FIG. 1.

Referring to FIGS. 4-5, a lever 240 is at least partially disposed within the housing 210 at an upper portion thereof.

The lever 240 can be selectively engaged with and disengaged from the handle 230, to thereby removably couple the handle 230 to the housing 210. For example, a user can apply an upward force to the lever 240 without the use of a tool (e.g., a screwdriver, pliers, etc.) to selectively disengage the lever 240 from the handle 230. The user or the installer can then remove the handle 230 from the assembly 200. Furthermore, the lever 240 is located near an upper portion of the housing 210, such that a user or an installer can easily access the lever 240 from within, for example, the tank 210 of the toilet 100 shown in FIGS. 1-2. In this way, the lever 240 facilitates easy and quick removal/replacement of the handle 230 from the actuator assembly 200 without the use of tools to allow for customization, servicing, or repair of the actuator assembly and the plumbing fixture.

As shown in FIGS. 4-7, the lever 240 includes a grip portion 241 located at a proximal end and an engagement portion 242 located at a distal end of the lever 240. The grip portion 241 has an L-shaped configuration to allow a user or an installer to grab and/or lift the lever 240 without the use of tools or other devices. According to an exemplary embodiment, the grip portion 241 can include a frictional coating (e.g., a rubberized coating, etc.), knurls, surface textures, or the like, to facilitate gripping of the lever by a user. The engagement portion 242 can engage at least a portion of the stem 232 of the handle 230 to securely couple the handle 230 along an axial direction within the housing 210.

Figure 6:
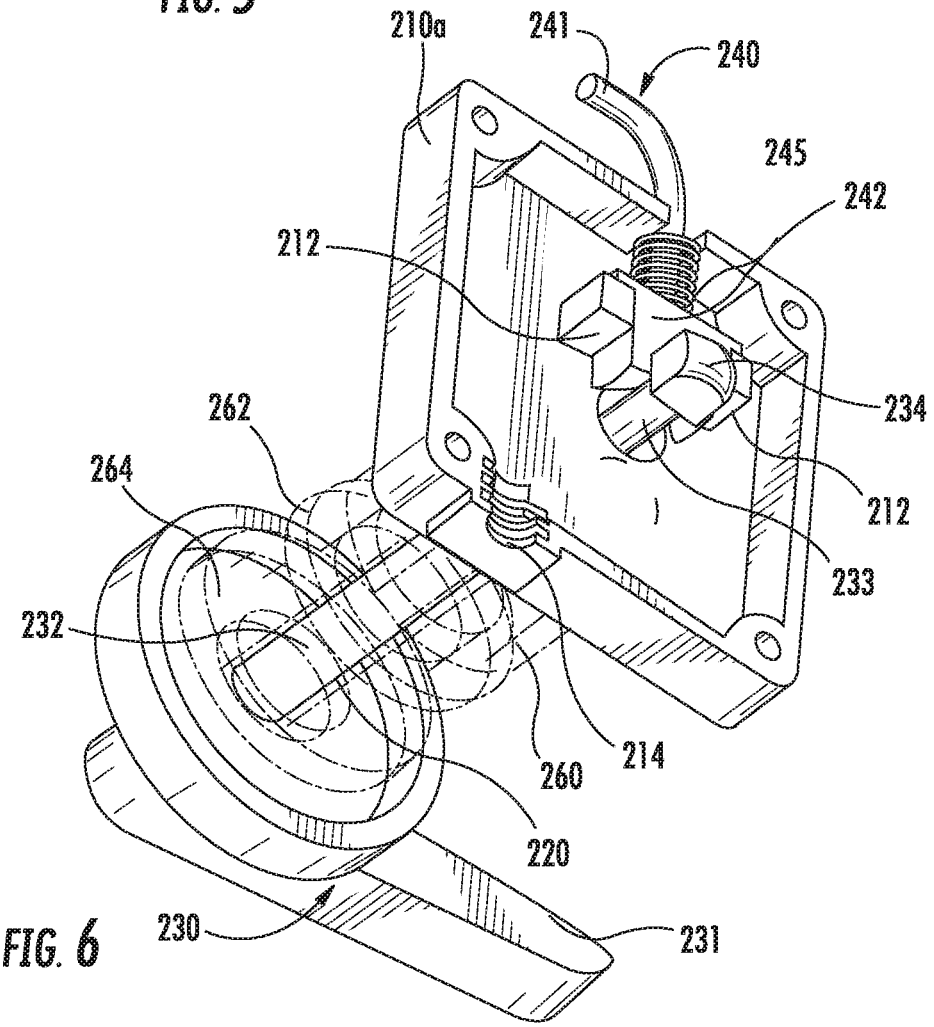
FIG. 6 is a perspective view of the flush actuator assembly of FIG. 1 with a handle shown coupled to the assembly.

As shown in FIG. 6, the engagement portion 242 includes an engagement surface 242*a* that is complementary to an outer surface of the stem 232. The stem 232 can include a recessed portion 233 (e.g., a cutout, a cavity, etc.), which can receive or mate with the engagement surface 242*a*. A portion of the poke-a-yoke feature 234 can contact a rear surface of the engagement portion 242 when the handle 230 is inserted into the housing 210. In this manner, the handle 230 can be secured along an axial direction within the housing 210, but is permitted to rotate or pivot relative to the housing 210 to perform a flush function. The engagement surface 242*a* can include a curved front edge (e.g., contoured, tapered, etc.) to facilitate insertion or coupling of the handle 230 to the housing 210, without having to manually lift the lever 240.

For example, when a user or an installer slides the handle 230 into the sleeve 220 and through the opening 216 of the front housing half 210*a*, the poke-a-yoke feature 234 will contact the front edge of the engagement surface 242*a*. By having a curved front edge on the engagement surface 242*a*, the poke-a-yoke feature 234 can push the engagement member 242 in an upward direction as the user or the installer slides the handle 230 into the housing 230 along an axial direction. This can allow the handle 230 to be fully inserted into the housing 230 until the engagement member 242 reaches the recessed portion 233, at which point the engagement member 242 will drop into the recessed portion 233 to securely couple the handle 230 within the housing 210. The engagement portion 242 can also include a pair of opposed tabs 243 (e.g., wings, flanges, etc.) extending outwardly away from the engagement portion 242. The opposed tabs 243 can engage or contact a pair of stops 212, respectively, located on the front housing half 210*a* and extending inward toward an interior of the housing 210. The opposed tabs 243 can help to regulate a position of the lever 240 within the housing 210 relative to the stem 232.

According to the exemplary embodiment of FIGS. 3-7, a biasing member 245 shown as a coil spring is disposed on or around a portion of the lever 240. The biasing member 245 is positioned between the engagement portion 242 and an interior wall of the housing 210, according to an exemplary embodiment. The biasing member 245 can provide a sufficient force (e.g., a spring force, etc.) to maintain engagement between the engagement portion 242 and the stem 232. That is to say, the biasing member 245 can bias the engagement member 242 toward the recessed portion 233 of the stem 232. According to an exemplary embodiment, the biasing member 245 also provides a sufficient force to maintain engagement between the opposed tabs 243 and the pair of stops 212. According to other exemplary embodiments, the biasing member 245 can be any other type of element capable of biasing the engagement portion 242 of the lever 240 toward the stem 232 (e.g., a helical spring, etc.). According to an exemplary embodiment, the biasing member 245 can have a spring constant K sufficient to enable a user or an installer to lift the lever 240 by applying an upward force without the use of tools (e.g., by hand) to selectively disengage the lever 240 from the stem 232. In this way, the handle 230 can be removed from the assembly without the use of tools or other devices.

In addition, the biasing member 245 can facilitate coupling of the handle 230 to the housing 210 without having to manually lift the lever 240. That is to say, a user or an installer can simply slide the handle 230 through the sleeve 220 and into the housing 210, such that the engagement member 242 automatically engages the recessed portion 233 of the stem 232. The engagement member 242 automatically drops into the recessed portion 233 by virtue of a biasing force of the biasing member 245 as the stem 232 slides into the housing 210. This is particularly advantageous if a user or an installer wishes to remove and/or replace the handle 230 to, for example, change the aesthetics of the plumbing fixture, perform maintenance, or replace other components of the actuator assembly 200 (e.g., arm 250, biasing member 245, etc.).

Figure 7:
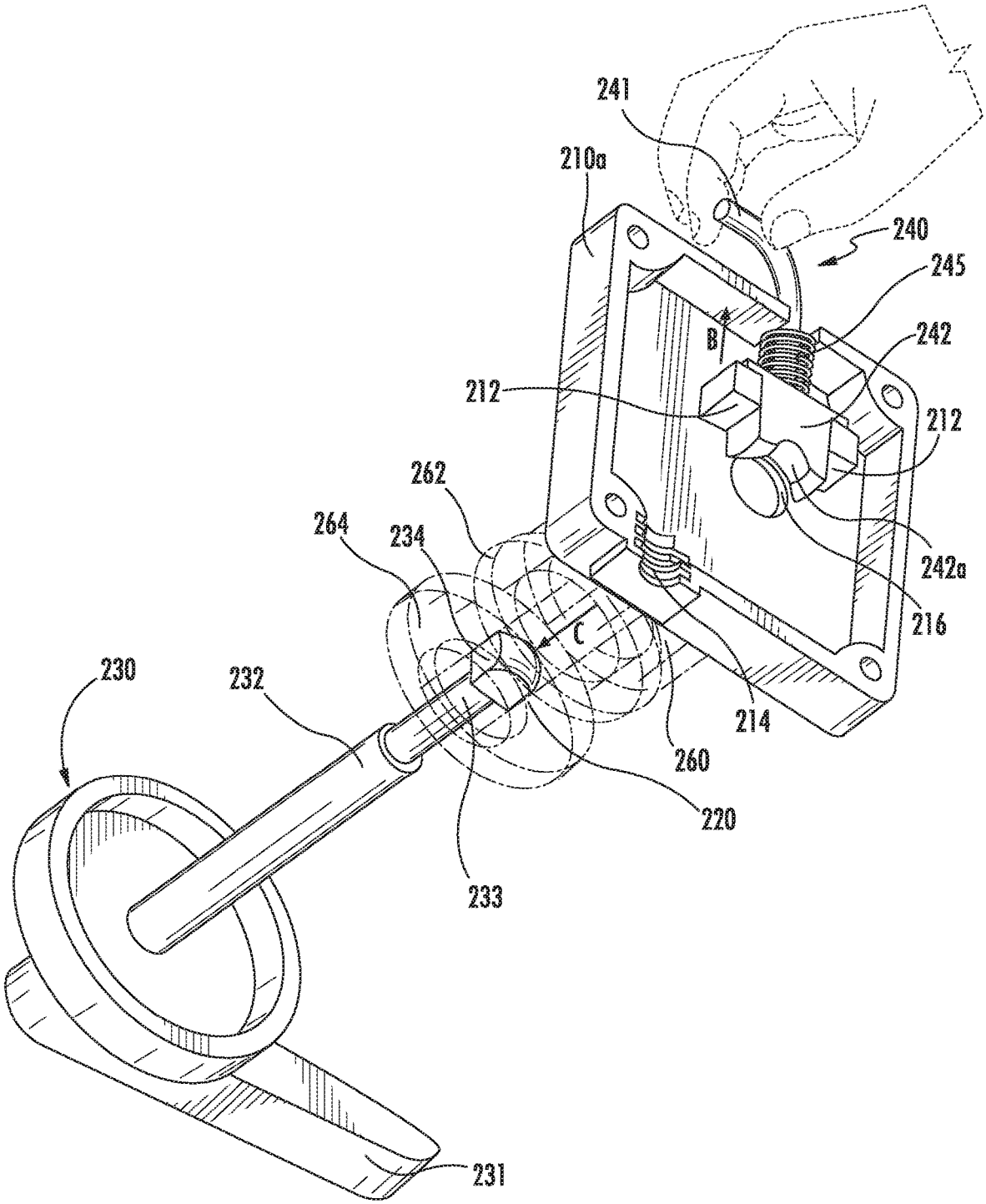
FIG. 7 is a perspective view of the flush actuator assembly of FIG. 6 with the handle shown being removed from the assembly according to an exemplary embodiment.

Referring to FIGS. 6-7, an exemplary installation and removal sequence for the handle 230 will be described. For ease of reference, the arm 250 and the rear housing half 210*b* are not shown in the assembly of FIGS. 6-7. As shown in FIG. 6, the handle 230 is coupled to the housing 210 via the lever 240. At this position, the handle 230 is permitted to be rotated or pivoted by a user to perform a flush function of, for example, the toilet 100. The engagement portion 242 is biased toward the stem 232 such that the engagement portion 242 is in contact with the stem 232 to securely couple the handle 230 to the housing 210 along an axial direction. The poke-a-yoke feature 234 of the stem 232 abuts a rear surface of the engagement portion 232 to set or maintain an axial position of the handle 230 relative to the housing 210.

Referring now to FIG. 7, when a user wishes to remove the handle 230 from the assembly, the user can manually lift the lever 240 in an upward direction indicated generally by arrow "B" in FIG. 7, without the use of tools or other devices. The upward lifting force exhibited by the user overcomes the biasing force of the biasing member 245 causing the biasing member 245 to compress and the engagement member 242 to be disengaged from the recessed portion 233 of the stem 232. The user can then slide the handle 230 through the sleeve 220 away from the front housing half 210*a* in a direction indicated generally by arrow "C" in FIG. 7. The user can then fully remove the handle 230 from the assembly 200. If the user wishes to install a new handle, such as a new handle having different aesthetics, the user can simply slide the stem of the new handle into the sleeve 220 through the opening 216. The stem can then contact or engage the engagement member 242 to push the engagement member 242 in an upward direction compressing the biasing member 245. As the stem is slid into the housing 210, the engagement member 242 will automatically engage a recessed portion of the stem due to the biasing force of the biasing member 245, to thereby couple the handle 230 along an axial direction within the housing 210.

According to an exemplary embodiment, the lever 240 can be made out of a rigid or a semi-rigid material or combinations of materials having sufficient material characteristics to allow for selective engagement with, and disengagement from, the handle 230 (e.g., nylon, ABS, etc.). According to an exemplary embodiment, the engagement surface 242*a* can include a lubricant (e.g., grease, etc.) to facilitate insertion and removal of the handle 230 from the assembly. According to various exemplary embodiments, the housing 210, the sleeve 220, the handle 230, the arm 250, the inner nut 260, and the outer nut 262, can be made out of any rigid or semi-rigid material or combinations of materials, such as plastic, metal, composite, or the like.

According to an exemplary embodiment, a flush actuator assembly for a plumbing fixture comprises a housing configured to be removably coupled to the plumbing fixture, a handle pivotally and removably coupled to the housing, the handle including a stem configured to extend through the plumbing fixture and into the housing, an arm removably coupled to the stem within the housing and configured to pivot with the handle, and a lever at least partially disposed in the housing and configured to be selectively disengaged from the stem to removably couple the handle to the housing.

In some exemplary embodiments, the lever is biased toward the stem, and the lever is configured to be selectively disengaged from the stem by applying an upward force to the lever.

In some exemplary embodiments, the lever is biased toward the stem by a biasing member disposed around a portion of the lever, and the lever is configured to automatically engage the stem to removably couple the handle to the housing by a biasing force of the biasing member.

In some exemplary embodiments, the arm includes a free end configured to receive a cable for controlling a flush valve of the plumbing fixture.

In some exemplary embodiments, the assembly further comprises a sleeve extending from the housing and configured to receive the stem of the handle therethrough, and the sleeve is configured to be inserted through an opening in the plumbing fixture.

In some exemplary embodiments, the first nut is configured to couple the housing to the plumbing fixture, and the sleeve includes an outer threaded portion, and wherein the first nut is configured to threadably engage the outer threaded portion of the sleeve.

In some exemplary embodiments, the assembly further comprises a second nut configured to threadably engage the outer threaded portion of the sleeve and to sandwich a portion of the plumbing fixture between the first nut and the second nut to removably couple the housing to the plumbing fixture.

A flush actuator assembly comprises a housing, a handle including a stem extending therefrom and configured to be pivotally and removably coupled to the housing, an arm disposed in the housing and configured to receive at least a portion of the stem and to pivot with the handle, a lever disposed in the housing and configured to be selectively disengaged from the stem to removably couple the handle to the housing, and a biasing member positioned between a portion of the lever and the housing, and configured to bias the lever toward the stem so as to maintain engagement between the lever and the stem.

In some exemplary embodiments, the lever is configured to be selectively disengaged from the stem by applying an upward force to the lever without the use of a tool.

In some exemplary embodiments, the lever is configured to automatically engage the stem to removably couple the handle to the housing by a biasing force of the biasing member.

In some exemplary embodiments, the arm includes a free end configured to receive a cable for controlling a flush valve of a plumbing fixture. In some exemplary embodiments, the assembly further comprises a sleeve extending from the housing and configured to receive the stem of the handle therethrough.

In some exemplary embodiments, the assembly further comprises a first nut configured to couple the housing to a plumbing fixture, and the sleeve includes an outer threaded portion, and the first nut is configured to threadably engage the outer threaded portion of the sleeve.

In some exemplary embodiments, the assembly further comprises a second nut configured to threadably engage the outer threaded portion of the sleeve and to sandwich a portion of the plumbing fixture between the first nut and the second nut to removably couple the housing to the plumbing fixture. A single-flush actuator assembly for a plumbing fixture comprises a housing, a handle including a stem and configured to be removably coupled to the housing, an arm disposed in the housing and configured to receive at least a portion of the stem and to pivot with the handle, and a lever assembly at least partially disposed in the housing and configured to be selectively disengaged from the stem to removably couple the handle to the housing, wherein a portion of the lever assembly is accessible at an outer portion of the housing and is configured to be actuated to remove the handle from the housing.

In some exemplary embodiments, the lever assembly is configured to be selectively disengaged from the stem by applying an upward force to the lever assembly without the use of a tool.

In some exemplary embodiments, the lever assembly comprises a lever, and a biasing member disposed around a portion of the lever, wherein the lever is configured to automatically engage the stem to removably couple the handle to the housing by a biasing force of the biasing member.

In some exemplary embodiments, the lever comprises an engagement portion having an engagement surface that is configured to engage a portion of the stem, and wherein the engagement surface has a shape that is complementary to a shape of the portion of the stem.

In some exemplary embodiments, the arm includes a free end configured to receive a cable for controlling a flush valve of a plumbing fixture.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present application.

What is claimed is:

1. A flush actuator assembly for a plumbing fixture, a housing configured to be removably coupled to the plumbing fixture;

a handle pivotally and removably coupled to the housing, wherein the handle includes a stem configured to extend through the plumbing fixture and into the housing;

an arm removably coupled to the stem within the housing, wherein the arm is configured to pivot with the handle; and a lever at least partially disposed in the housing, wherein the lever is biased toward the stem by a coil spring, and wherein the lever is configured to be selectively disengaged from the stem to removably couple the handle to the housing.

2. The flush actuator assembly of claim 1, wherein the lever is configured to be selectively disengaged from the stem by applying an upward force to the lever without the use of a tool.

3. The flush actuator assembly of claim 1, wherein the lever is configured to automatically engage the stem to removably couple the handle to the housing by a biasing force of the coil spring.

4. The flush actuator assembly of claim 1, wherein the arm includes a free end configured to receive a cable for controlling a flush valve of the plumbing fixture.

5. The flush actuator assembly of claim 1, further comprising a sleeve extending from the housing, wherein the sleeve is configured to receive the stem of the handle therethrough, and wherein the sleeve is configured to be inserted through an opening in the plumbing fixture.

6. The flush actuator assembly of claim 5, further comprising a first nut configured to couple the housing to the plumbing fixture, wherein the sleeve includes an outer threaded portion, and wherein the first nut is configured to threadably engage the outer threaded portion of the sleeve.

7. The flush actuator assembly of claim 6, further comprising a second nut configured to threadably engage the outer threaded portion of the sleeve and to sandwich a portion of the plumbing fixture between the first nut and the second nut to removably couple the housing to the plumbing fixture.

8. A flush actuator assembly, comprising:

a housing;

a handle including a stem extending therefrom, wherein the handle is configured to be pivotally and removably coupled to the housing;

an arm disposed in the housing, wherein the arm is configured to receive at least a portion of the stem and to pivot with the handle;

a lever disposed in the housing, wherein the lever is configured to be selectively disengaged from the stem to removably couple the handle to the housing; and a coil spring positioned between a portion of the lever and the housing, wherein the coil spring is configured to bias the lever toward the stem so as to maintain engagement between the lever and the stem.

9. The flush actuator assembly of claim 8, wherein the lever is configured to be selectively disengaged from the stem by applying an upward force to the lever without the use of a tool.

10. The flush actuator assembly of claim 8, wherein the lever is configured to automatically engage the stem to removably couple the handle to the housing by a biasing force of the coil spring.

11. The flush actuator assembly of claim 8, wherein the arm includes a free end configured to receive a cable for controlling a flush valve of a plumbing fixture.

12. The flush actuator assembly of claim 8, further comprising a sleeve extending from the housing, wherein the sleeve is configured to receive the stem of the handle therethrough.

13. The flush actuator assembly of claim 12, further comprising a first nut configured to couple the housing to a plumbing fixture, wherein the sleeve includes an outer threaded portion, and wherein the first nut is configured to threadably engage the outer threaded portion of the sleeve.

14. The flush actuator assembly of claim 13, further comprising a second nut configured to threadably engage the outer threaded portion of the sleeve and to sandwich a portion of the plumbing fixture between the first nut and the second nut to removably couple the housing to the plumbing fixture.

15. A flush actuator assembly for a plumbing fixture, comprising:

a housing;

a handle including a stem, wherein the handle is configured to be removably coupled to the housing;

an arm disposed in the housing, wherein the arm is configured to receive at least a portion of the stem and to pivot with the handle;

a lever assembly at least partially disposed in the housing, wherein the lever assembly is configured to be selectively disengaged from the stem to removably couple the handle to the housing; and wherein the lever assembly includes a lever and a separate biasing member that at least partially encircles the lever, the separate biasing member configured to bias the lever toward the stem;

wherein a portion of the lever assembly is accessible at an outer portion of the housing and is configured to be actuated to remove the handle from the housing.

16. The flush actuator assembly of claim 15, wherein the lever assembly is configured to be selectively disengaged from the stem by applying an upward force to the lever assembly without the use of a tool.

17. The flush actuator assembly of claim 15, wherein the lever is configured to automatically engage the stem to removably couple the handle to the housing by a biasing force of the biasing member.

18. The flush actuator assembly of claim 17, wherein the lever assembly further comprises an engagement portion having an engagement surface that is configured to engage a portion of the stem.

19. The flush actuator assembly of claim 18, wherein the engagement surface has a shape that is complementary to a shape of the portion of the stem.

20. The flush actuator assembly of claim 15, wherein the arm includes a free end configured to receive a cable for controlling a flush valve of a plumbing fixture.

* * * * *